US012535279B2

(12) United States Patent
Turlakov

(10) Patent No.: US 12,535,279 B2
(45) Date of Patent: Jan. 27, 2026

(54) TURLAKOV'S RIFLE N 9 (COSSACK CARBINE)

(71) Applicant: Maxim Turlakov, Ferlach (AT)

(72) Inventor: Maxim Turlakov, Ferlach (AT)

(73) Assignee: MAXIM TURLAKOV, Ferlach (AT)

( * ) Notice: Subject to any disclaimer, the term of this patent is extended or adjusted under 35 U.S.C. 154(b) by 0 days.

(21) Appl. No.: 17/802,950

(22) PCT Filed: Feb. 24, 2021

(86) PCT No.: PCT/RU2021/000076

§ 371 (c)(1),
(2) Date: Aug. 28, 2022

(87) PCT Pub. No.: WO2021/177856

PCT Pub. Date: Sep. 10, 2021

(65) Prior Publication Data

US 2023/0101014 A1 Mar. 30, 2023

(30) Foreign Application Priority Data

Mar. 4, 2020 (RU) ..... RU2020109540

(51) Int. Cl.
*F41A 3/72* (2006.01)
*F41A 3/18* (2006.01)

(52) U.S. Cl.
CPC . *F41A 3/18* (2013.01); *F41A 3/72* (2013.01)

(58) Field of Classification Search
CPC ..... F41A 3/18; F41A 3/24; F41A 3/72
See application file for complete search history.

(56) References Cited

U.S. PATENT DOCUMENTS 1,349,675 A * 8/1920 Johnson ..... F41A 15/12 42/16
1,863,776 A * 6/1932 Watson ..... F41C 7/02 42/16
2,365,307 A * 12/1944 Swebilius ..... F41A 3/64 42/16
2,387,413 A * 10/1945 Shaffnit ..... F41C 7/02 42/16
2,436,175 A * 2/1948 Neal ..... F41A 17/56 42/71.01
2,499,878 A * 3/1950 Raymond ..... F41C 7/02 42/16
2,552,214 A * 5/1951 Raymond ..... F41C 7/02 236/35
2,667,817 A * 2/1954 Asby, Jr. ..... F41A 25/22 89/172
3,020,662 A * 2/1962 Merkel ..... F41A 19/39 42/69.01
3,188,763 A * 6/1965 Duncan ..... F41C 3/00 42/16
3,816,950 A * 6/1974 Vesamaa ..... F41A 3/72 42/16
4,651,455 A * 3/1987 Geiser, Jr. ..... F41C 33/08 42/70.08

(Continued)

*Primary Examiner* — Derrick R Morgan

(57) ABSTRACT

The invention relates to hand firearm and is aimed at improving the ergonomics of firearm with a bullpup layout. The specified technical result is achieved by the fact that the bolt of the firearm has an extension of the bolt handle, which makes it possible to position the bolt handle near the trigger, thereby facilitating the process of reloading the firearm.

1 Claim, 16 Drawing Sheets

(56) References Cited

U.S. PATENT DOCUMENTS

| | | | | | |
|---|---|---|---|---|---|
| 4,967,642 | A * | 11/1990 | Mihaita | F41C 23/04 | D22/104 |
| 5,259,137 | A * | 11/1993 | Blenk | F41A 3/42 | 42/16 |
| 5,834,678 | A * | 11/1998 | Kalb | F41A 3/46 | 89/14.3 |
| 7,000,345 | B1 * | 2/2006 | Kay | F41A 19/30 | 89/187.01 |
| 8,266,998 | B1 * | 9/2012 | Davis | F41A 3/72 | 89/1.4 |
| 8,683,726 | B1 * | 4/2014 | Genton | F41A 3/24 | 42/17 |
| 9,194,635 | B1 * | 11/2015 | Gibbens | F41A 3/12 | |
| 9,658,009 | B1 * | 5/2017 | Vankeuren, III | F41A 3/22 | |
| 10,006,726 | B1 * | 6/2018 | Oglesby | F41A 3/20 | |
| 11,300,377 | B2 * | 4/2022 | Young | F41A 19/10 | |
| 11,644,260 | B1 * | 5/2023 | Douvier | F41A 11/02 | 42/75.01 |
| 2003/0066226 | A1 * | 4/2003 | Martin | F41A 3/72 | 42/16 |
| 2014/0360076 | A1 * | 12/2014 | Zamlinsky | F41C 23/20 | 42/75.03 |
| 2015/0276333 | A1 * | 10/2015 | DiOrio | F41A 3/24 | 42/16 |
| 2020/0263942 | A1 * | 8/2020 | Karagias | F41A 15/14 | |
| 2021/0080213 | A1 * | 3/2021 | Young | F41A 19/15 | |
| 2021/0254914 | A1 * | 8/2021 | Calvete | F41A 3/24 | |
| 2023/0014919 | A1 * | 1/2023 | Karagias | F41A 3/22 | |
| 2024/0328735 | A1 * | 10/2024 | Segraves | F41A 3/66 | |
| 2025/0020425 | A1 * | 1/2025 | Dentler | F41A 17/38 | |

* cited by examiner

TURLAKOV'S RIFLE N 9 (COSSACK CARBINE)

TECHNICAL FIELD

The invention relates to the field of firearm technology and can be used in a non-automatic firearm with manual reloading after each shot, in which the barrel is locked when the bolt is turned using the handle fixed to the bolt, and having the magazine located between the pistol grip and the butt stock, that is, made in bullpup design.

BACKGROUND OF THE INVENTION

Known technical solutions, for example, DSR rifles (Fedoseev S. L. "Sniper Rifles" p. 254), U.S. Pat. No. 548, 373S1, US 20120073179A1, the disadvantage of which is the large distance from the trigger to the bolt handle which makes reloading the firearm much more difficult.

Also known is the OTs-48K rifle (Fedoseev S. L. "Sniper Rifles", p. 192), which has the bolt reloading handle located near the trigger and connected to the bolt by means of an extension. The disadvantage of this design is that the axis of rotation of the reloading handle does not coincide with the longitudinal axis of the barrel, which greatly complicates the design.

Known designs of firearms RU 2331831C1, RU 2235259C1, in which the bolt is rotated in the process of straight pull movement of the reloading handle. These systems have significant complexity, high reloading force, large stroke of the reloading handle, what forces it to be carried far ahead of the trigger, which also worsens the ergonomics of the firearm.

DISCLOSURE OF THE INVENTION

The present invention solves the problem of bringing the bolt handle closer to the trigger to facilitate the process of reloading the firearm.

To achieve the specified technical result, it is proposed the bolt which locking the barrel during its rotation and the bolt handle connect with the handle extension so that the handle and the bolt in the process of unlocking and locking the barrel rotate together around the longitudinal axis of the barrel.

BRIEF DESCRIPTION OF DRAWINGS

The essence of the invention is illustrated by drawings, where:

on FIG. 1—shows the appearance of the proposed firearm;

Figure 2:
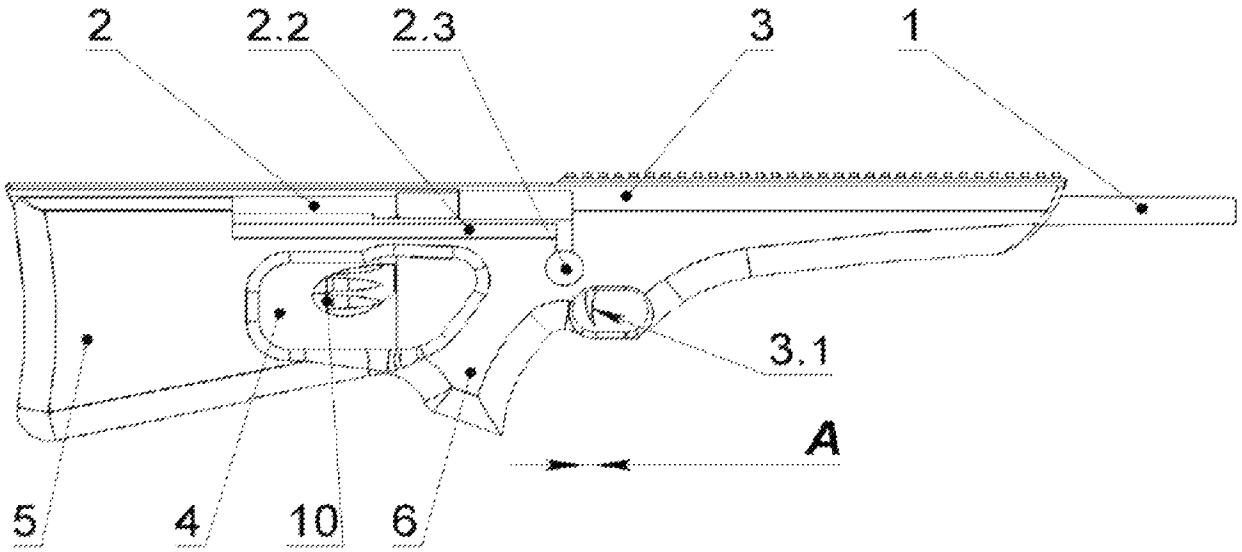
Figure 3:
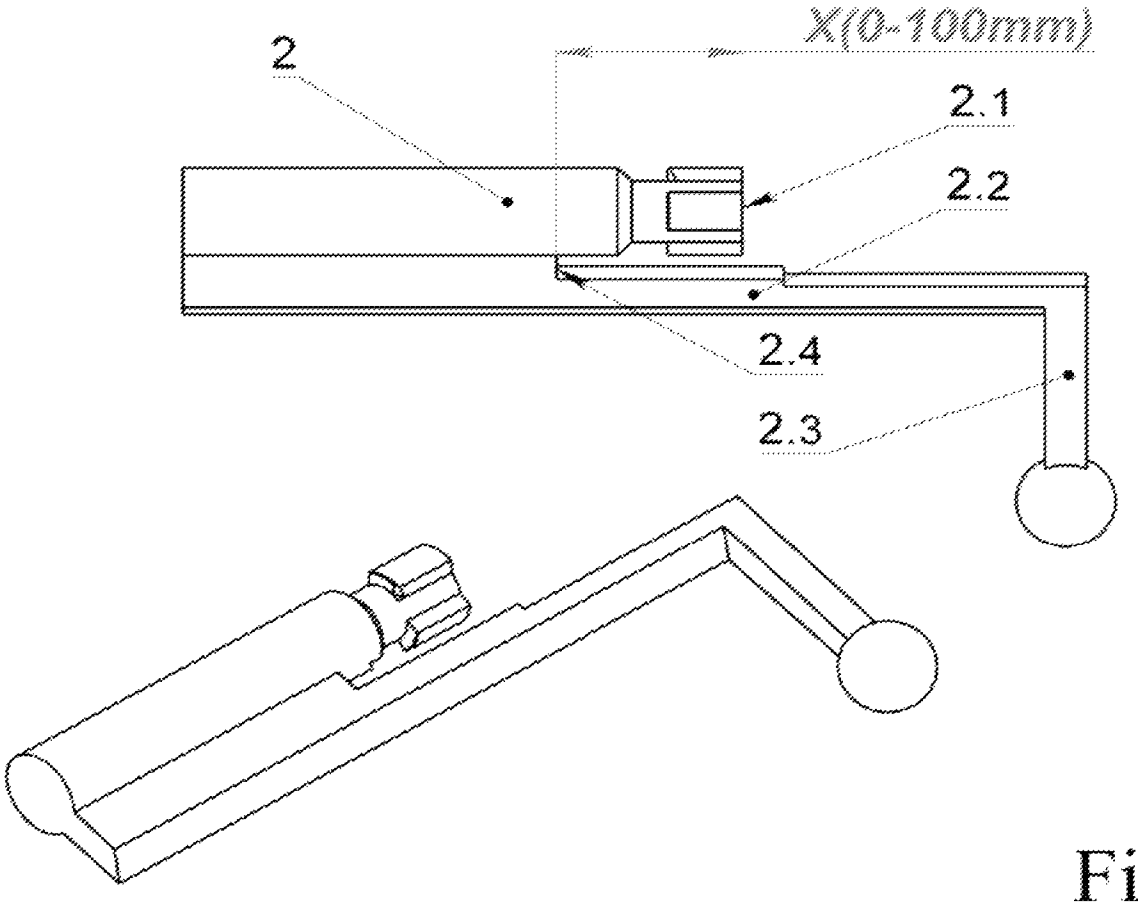
Figure 4:
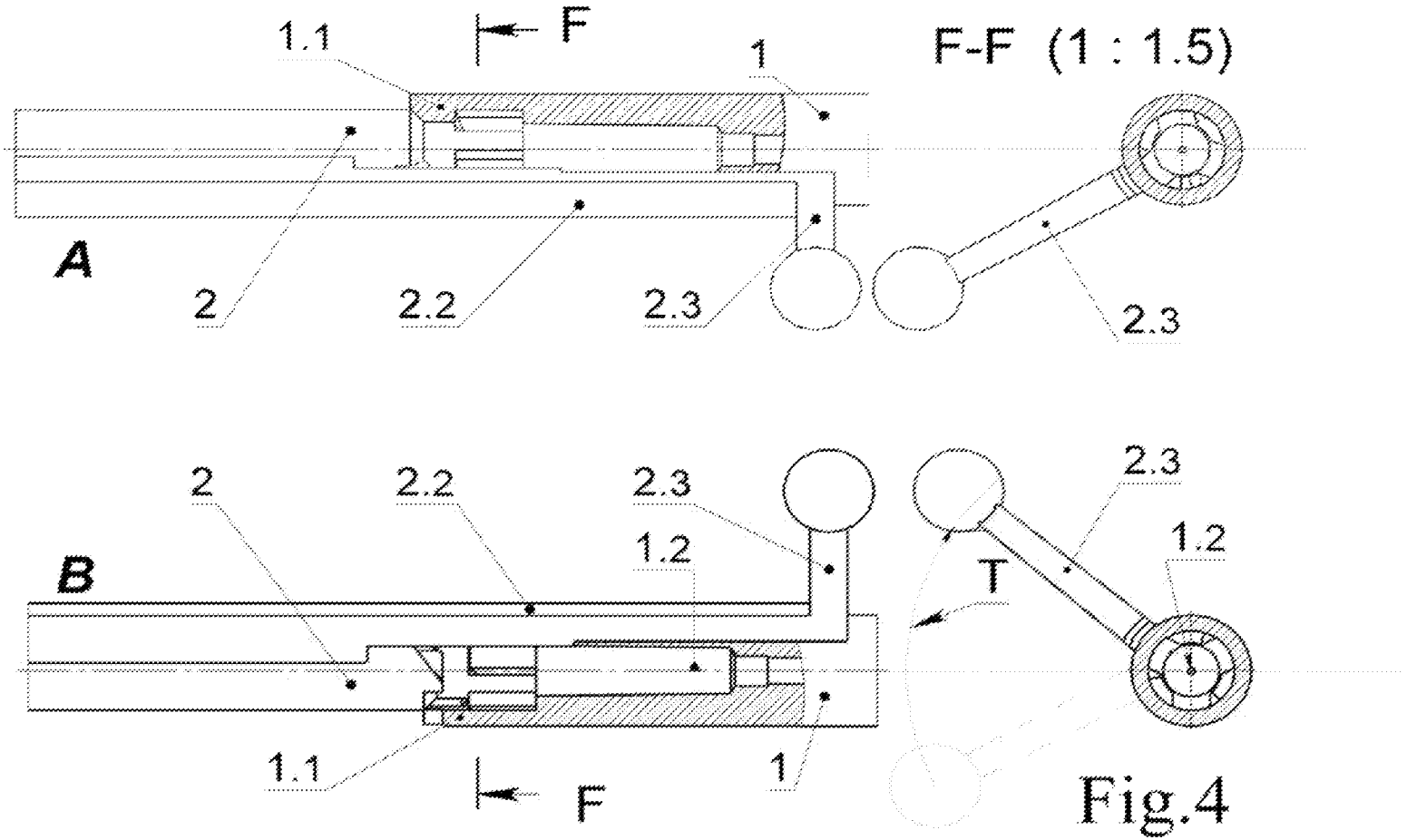
Figure 5:
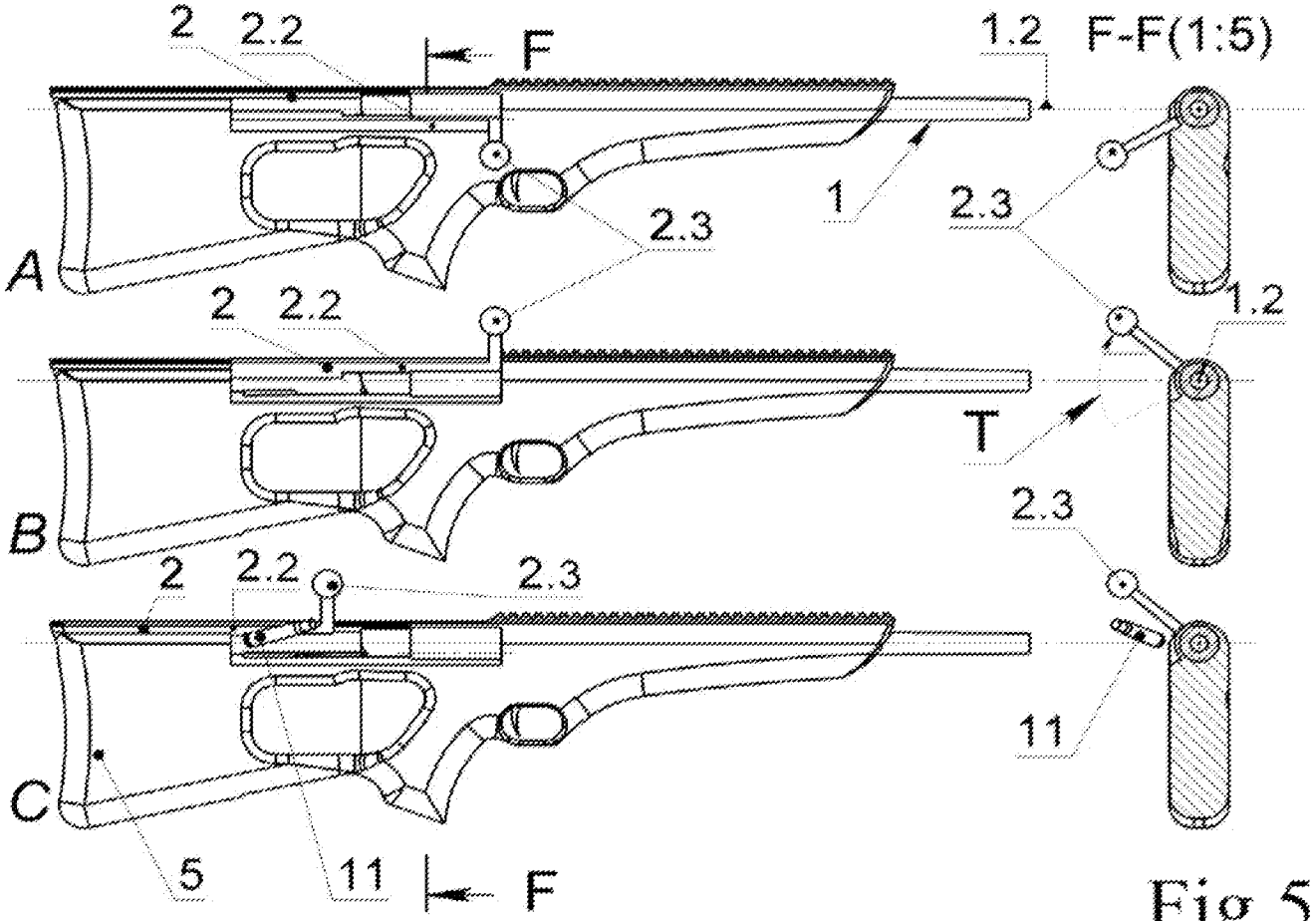
Figure 6:
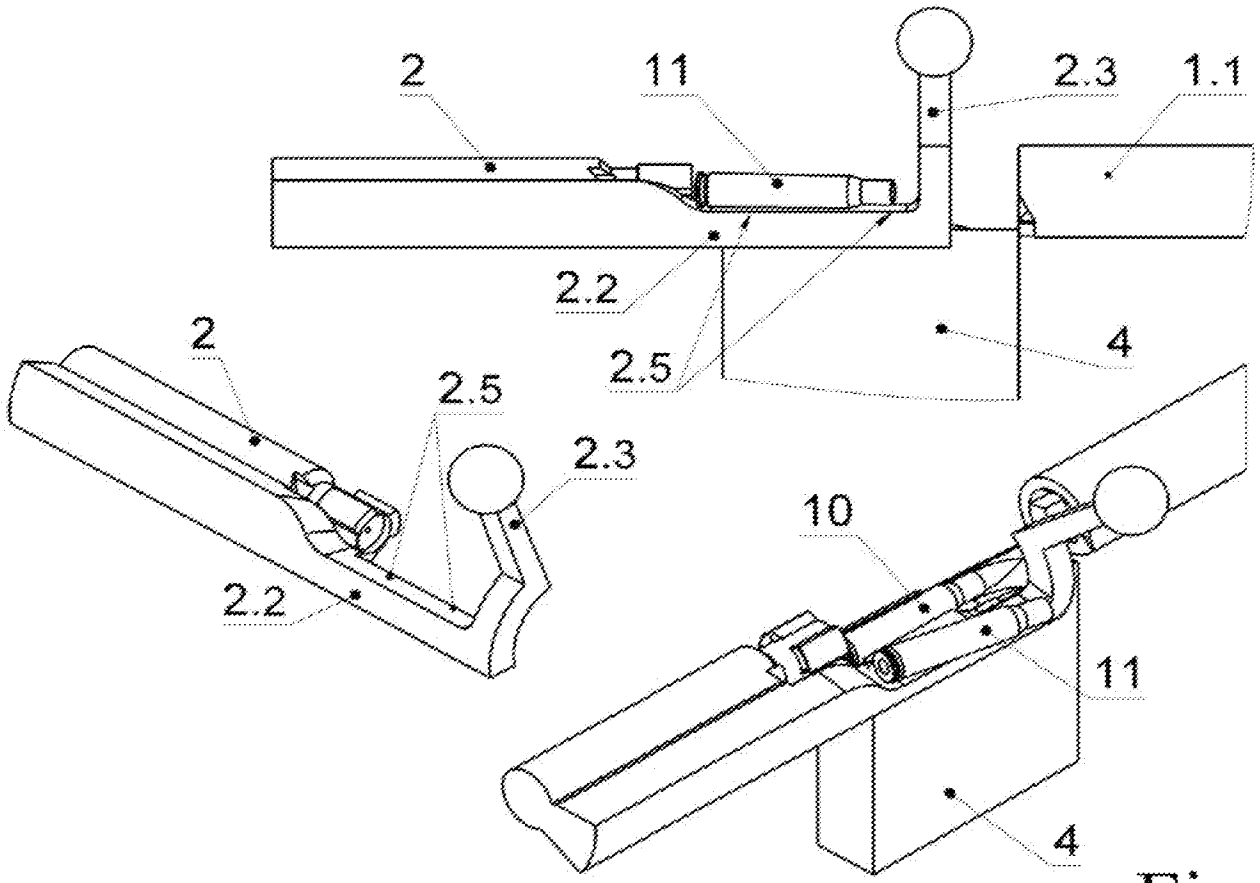
Figure 7:
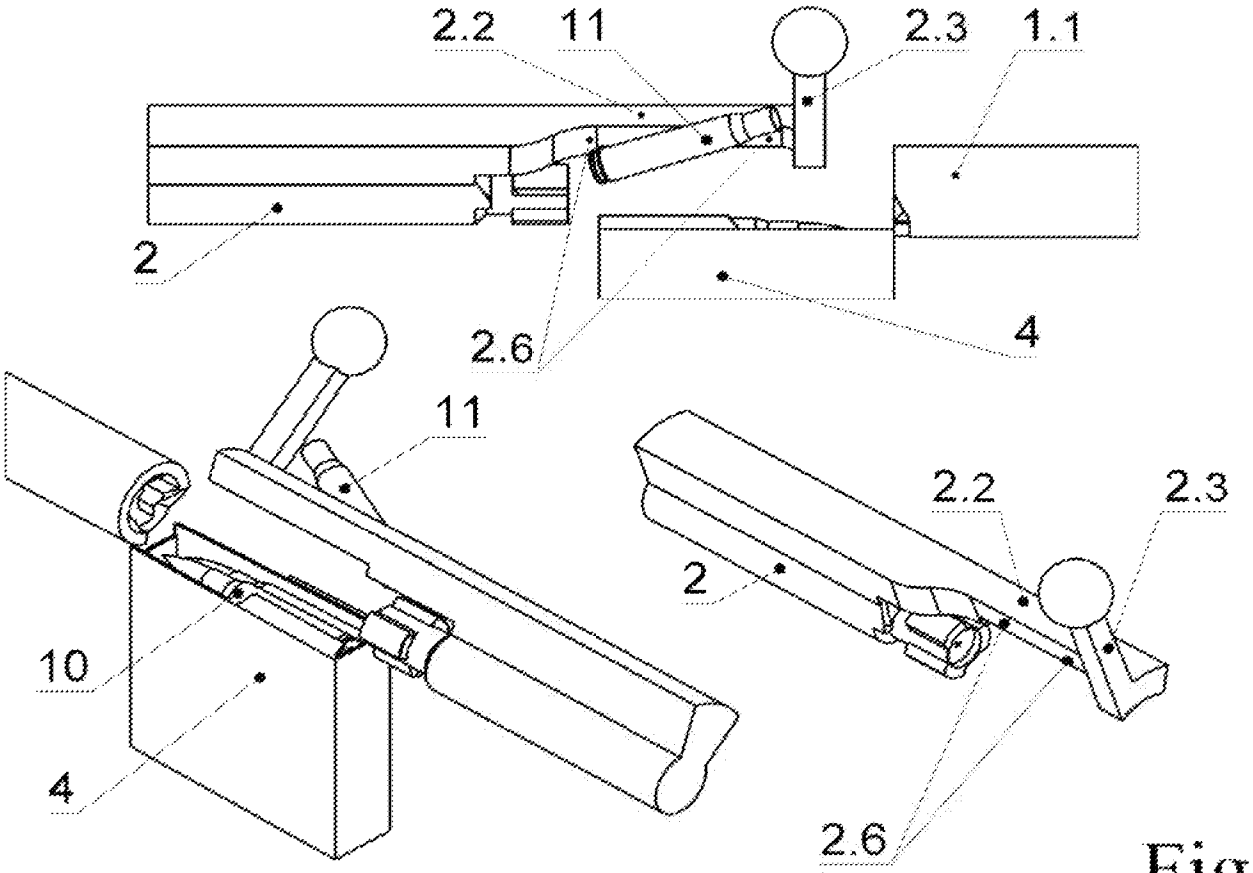
Figure 8:
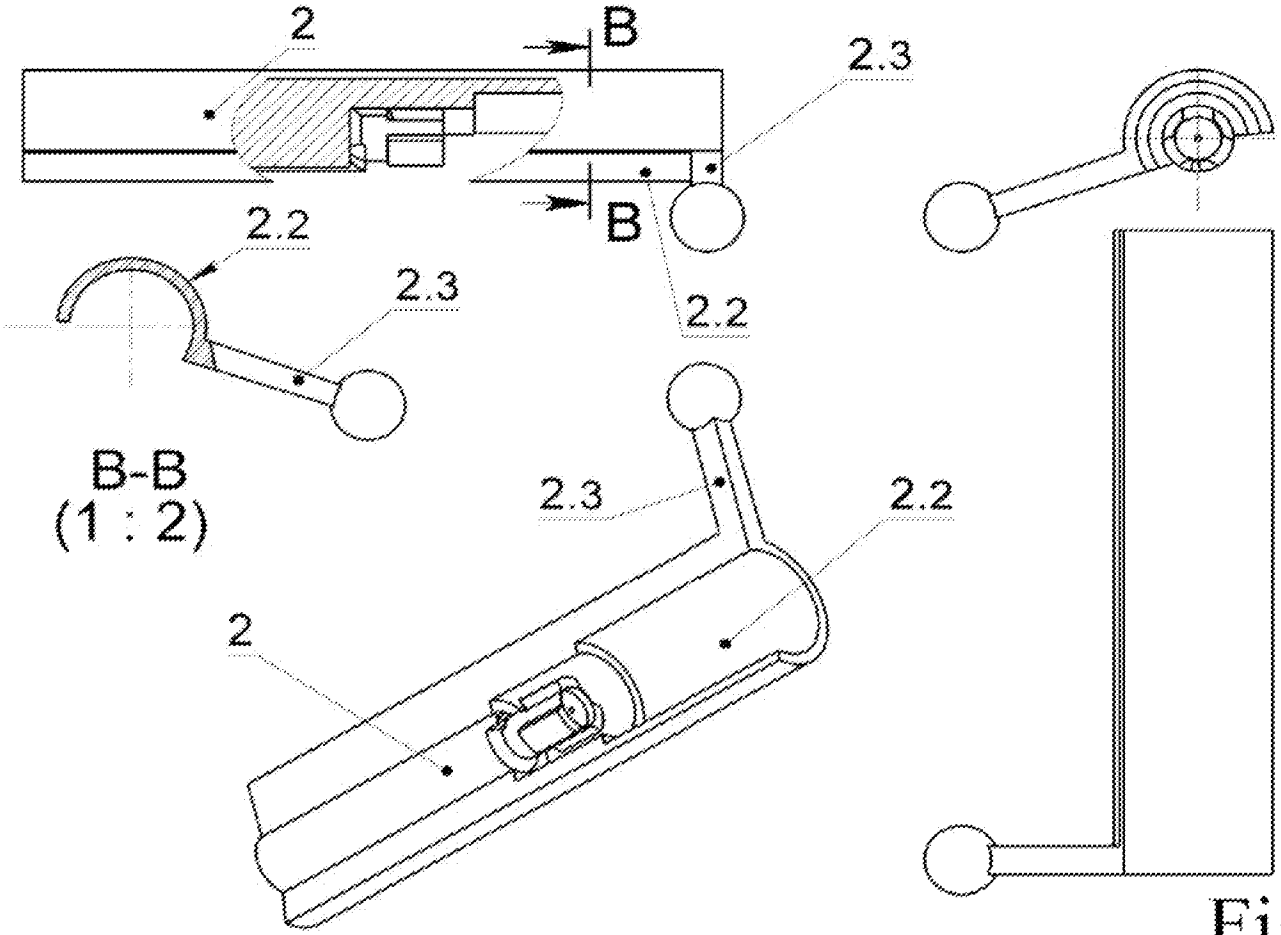
Figure 9:
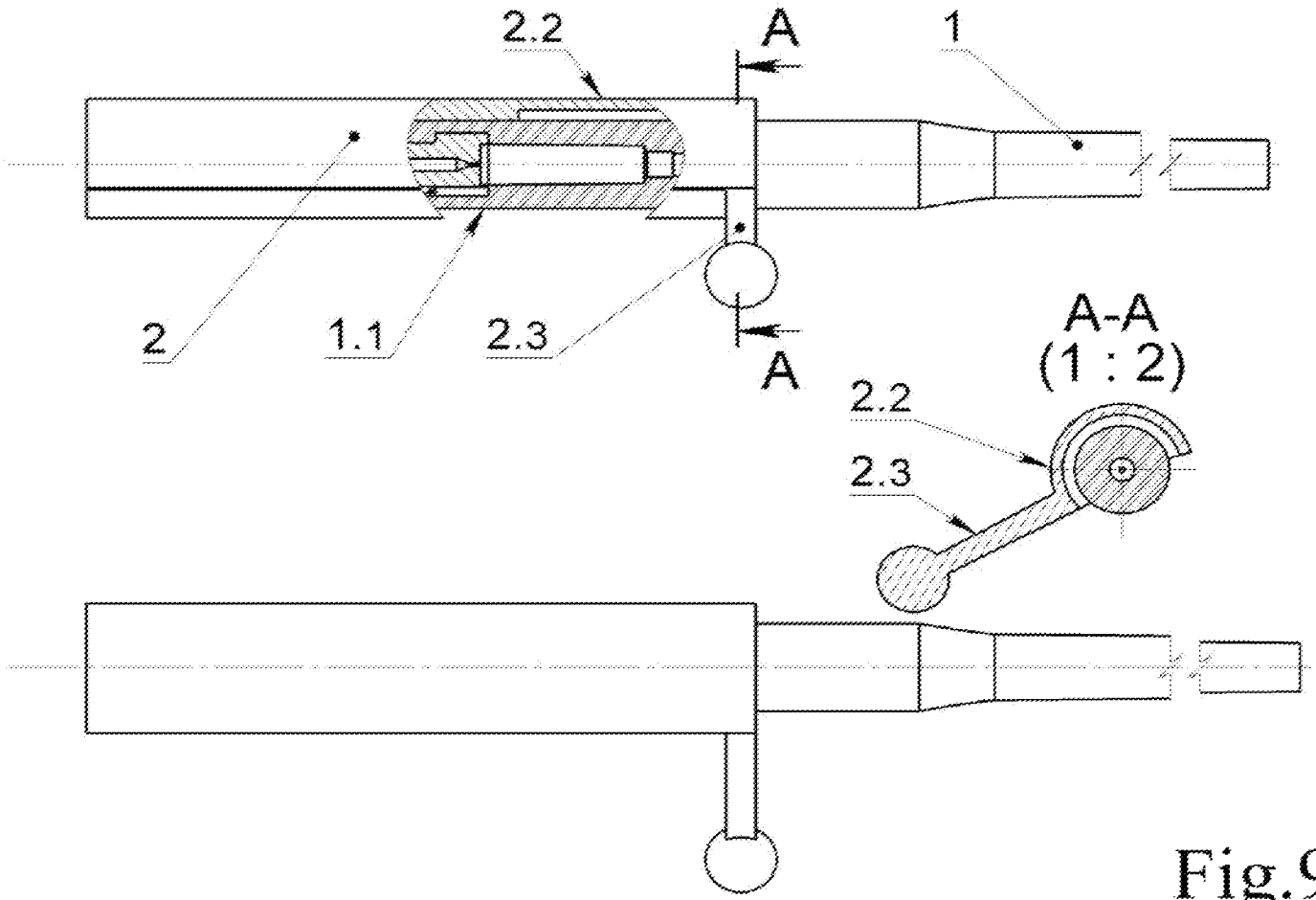
Figure 10:
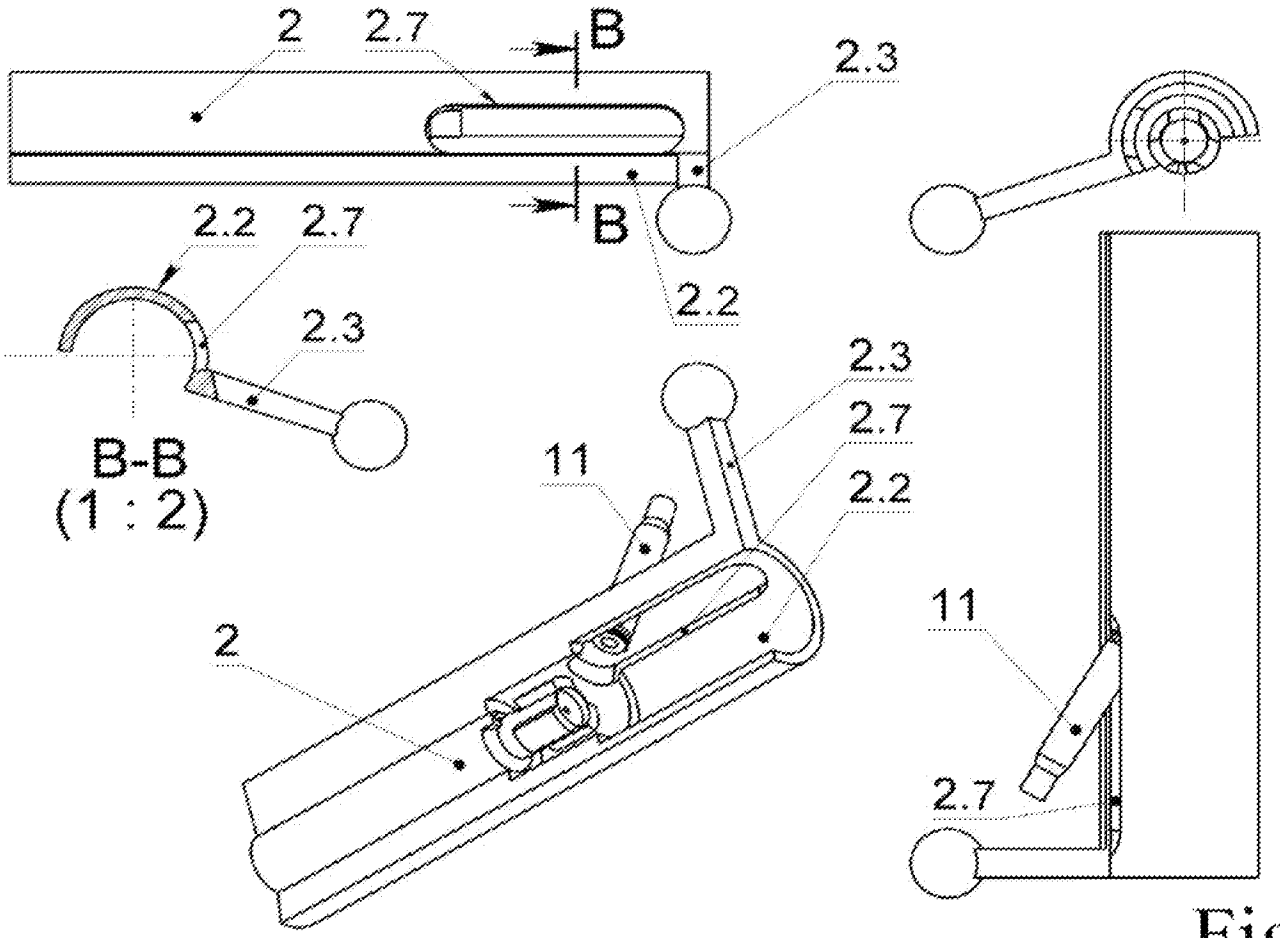
Figure 11:
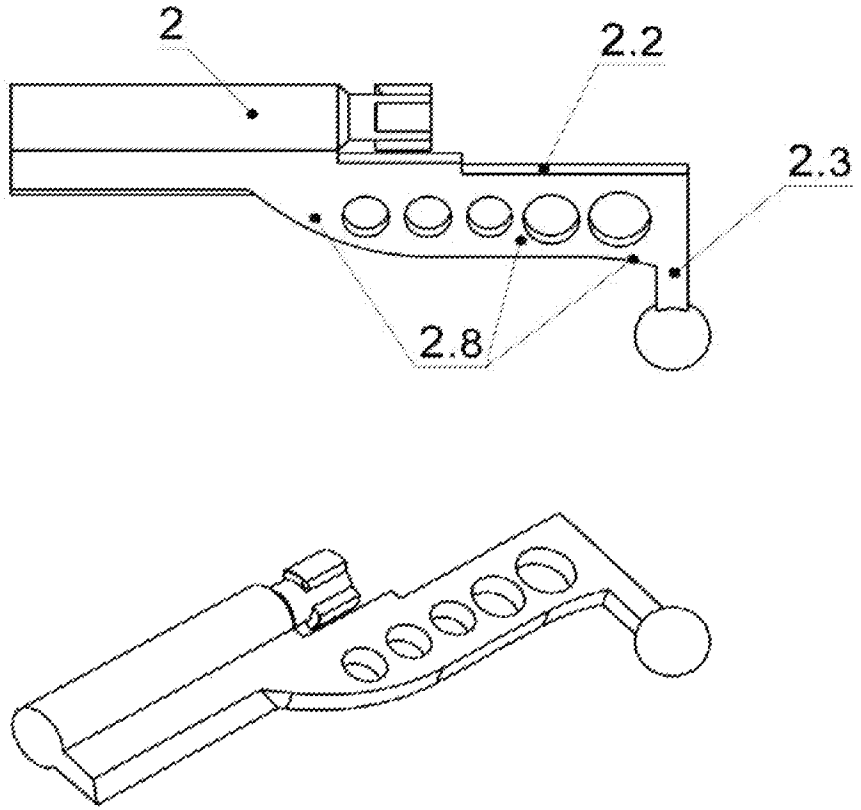
Figure 12:
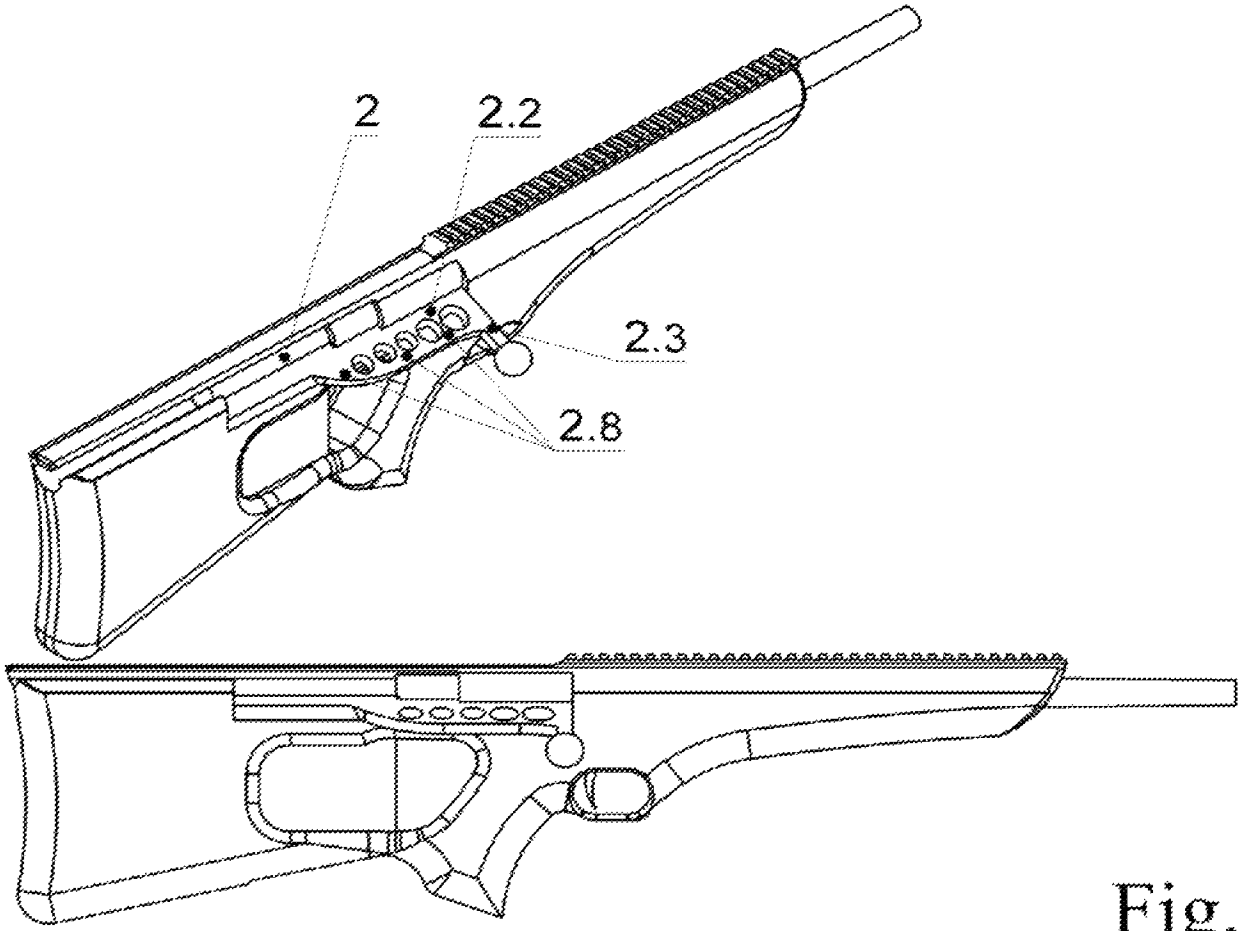
Figure 13:
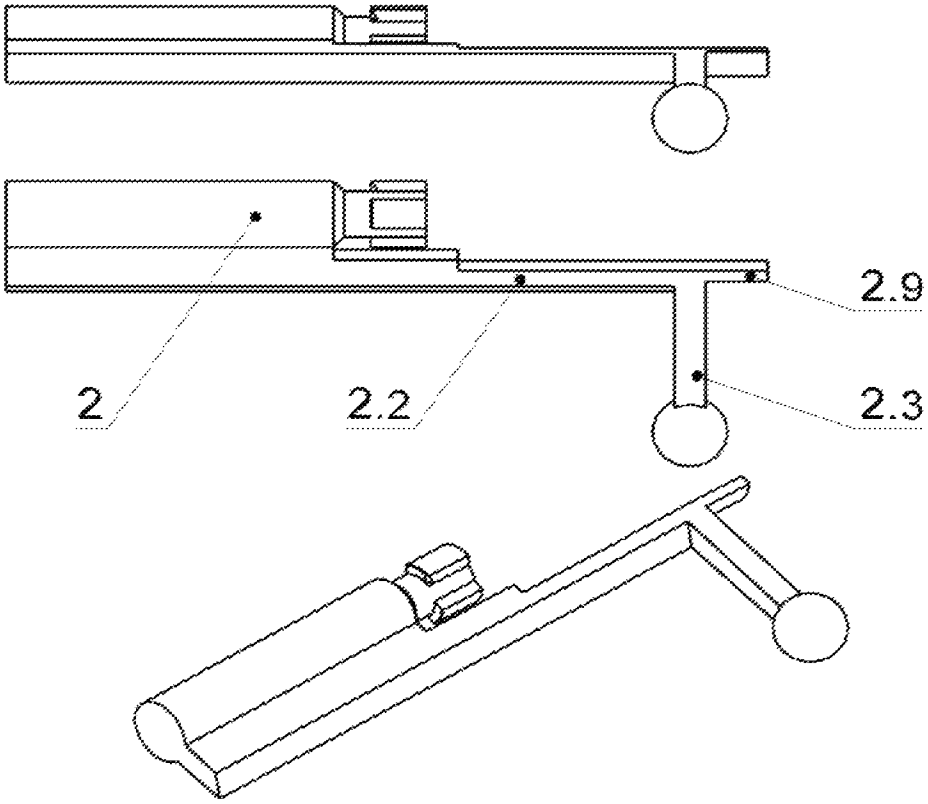
Figure 14:
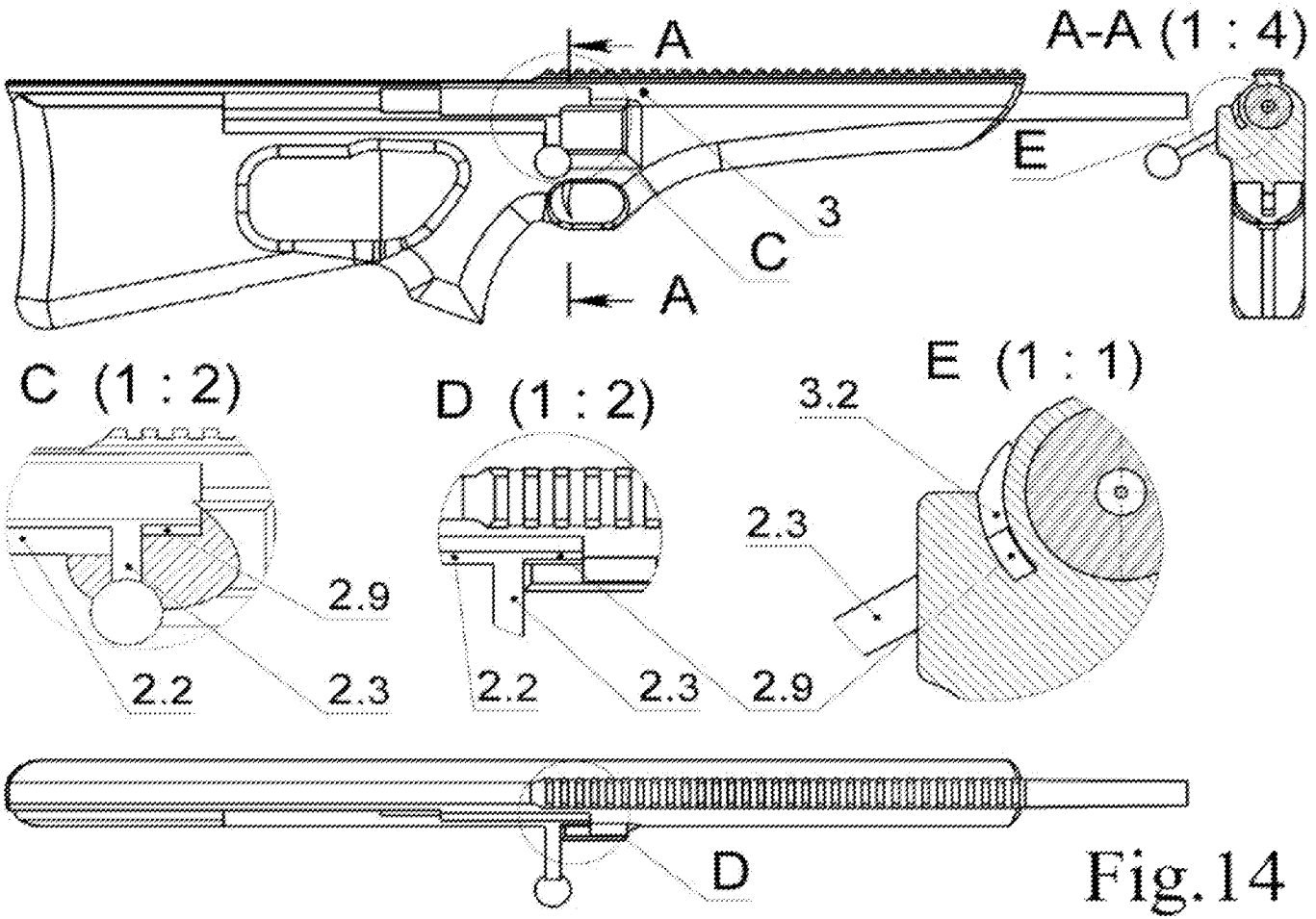
Figure 15:
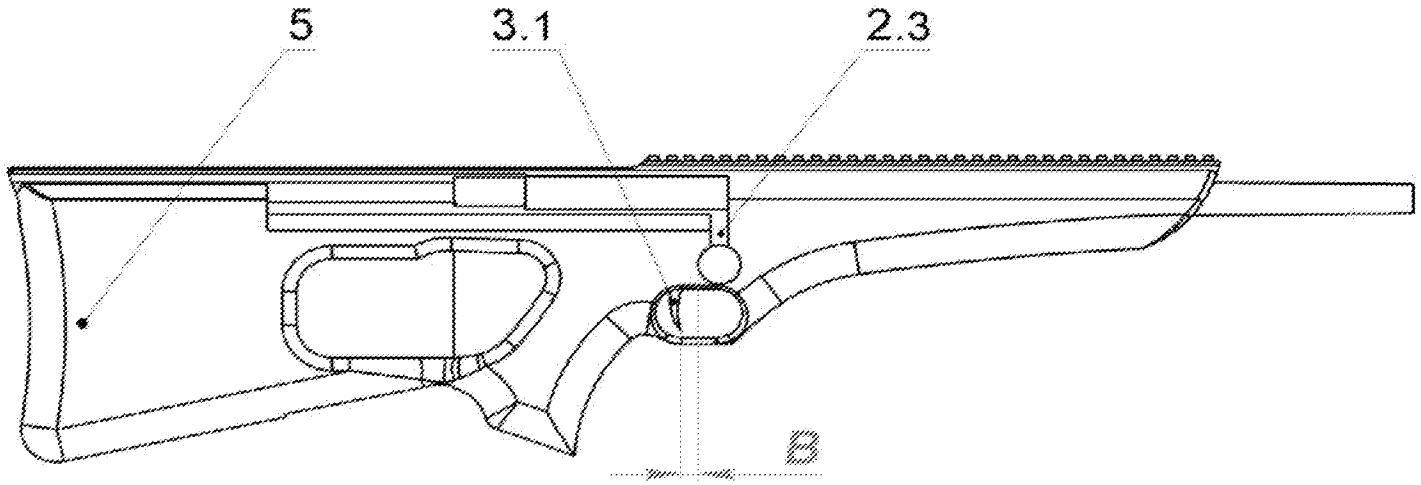
Figure 16:
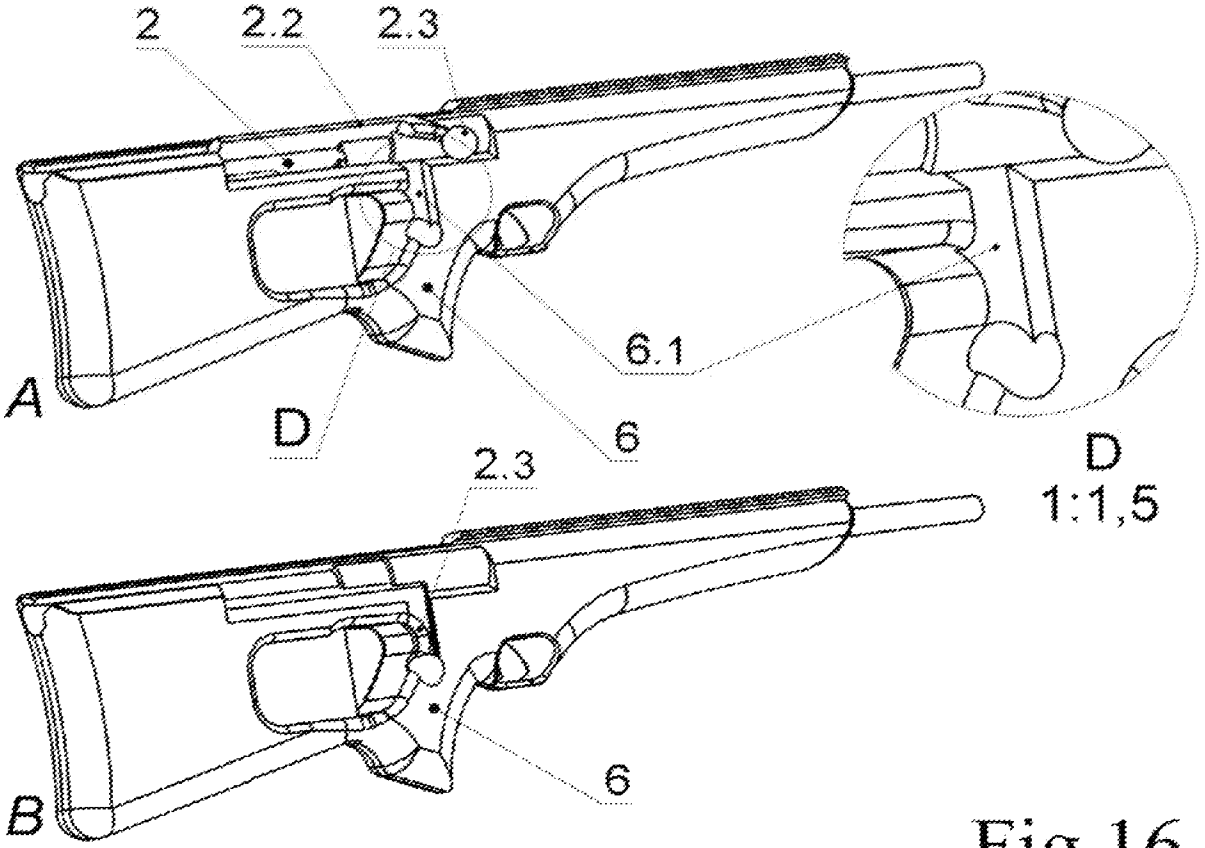

on FIG. 2—shows the appearance of the firearm in the variant when the bolt handle is placed between the trigger and the butt stock, the designation of the main details;

on FIG. 3—shows the appearance of the bolt with the handle extension;

on FIG. 4—shows the appearance of the bolt with the handle extension and the barrel locking diagrams, views A, B, section along F-F;

on FIG. 5—shows views A, B, C, section along F-F, demonstrating the functioning of the firearm;

on FIG. 6—shows the bolt, and the process diagram in the variant when the case is ejected over the extension of the bolt handle;

on FIG. 7—shows the bolt and the process diagram in the variant when the case is ejected under the extension of the bolt handle;

on FIG. 8—shows the variant of the bolt, when the handle extension has the cross section in the form of a ring sector, section along B-B;

on FIG. 9—shows the locking of the barrel with the bolt with the handle extension, having in cross section the form of a ring sector, section along A-A;

on FIG. 10—shows the variant of the bolt with the handle extension, having in cross section the form of a ring sector and containing the slot for ejection of the case, section along B-B;

on FIG. 11—shows the bolt in the variant when the handle extension has the reinforcement;

on FIG. 12—shows the appearance of the firearm when the handle extension has the reinforcement;

on FIG. 13—shows the bolt in the variant when the handle extension has the protrusion that enters the recess of the receiver;

on FIG. 14—shows the appearance of the firearm in the variant when the bolt handle extension has the protrusion that enters the recess of the receiver, section along A-A, local views C, D, E;

on FIG. 15—shows the appearance of the firearm in the variant when the trigger is located between the bolt handle and the butt stock;

on FIG. 16—shows the appearance of the firearm in the variant when the bolt handle enters the recess on the pistol grip, views A, B, local view D.

Figure 1:
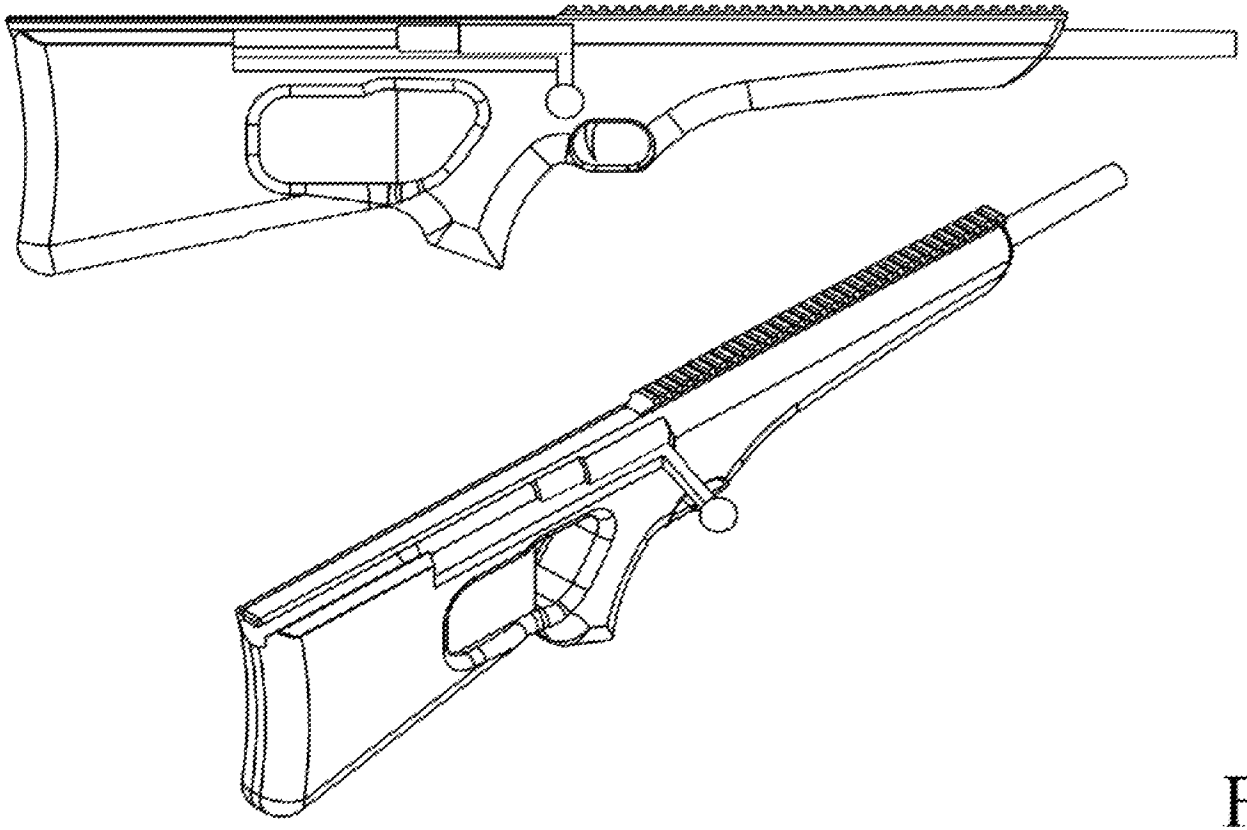

The best embodiment of the invention:

The firearm (FIG. 1, FIG. 2) contains the barrel 1, the bolt 2, the extension of the bolt handle 2.2, the bolt handle 2.3, the receiver 3, the trigger 3.1, the magazine 4 with cartridges 10, located between the butt stock 5 and the pistol grip 6.

The bolt handle 2.3 is located between the trigger 3.1 and the butt stock 5, which shows the distance A.

The bolt 2 (FIG. 3) is connected to the handle 2.3 by means of the handle extension 2.2.

In this case, the beginning of the attachment 2.4 of the handle extension 2.2 to the bolt 2 is located no more than 100 min from the front end of the bolt 2.1 (size X).

In view A (FIG. 4) shows the position of the bolt 2 in the breech 1.1 when the barrel 1 is locked.

Rotation of the bolt handle 2.3 (view B, FIG. 4) along the trajectory T around the longitudinal axis of the barrel 1.2 causes the rotation of the bolt 2 and the barrel 1 is unlocked.

The operation of the firearm as a whole is shown in FIG. 5 where:

in view A, the position with the closed bolt;

in view B, turn of the bolt handle 2.3 around the axis of the barrel 1.2 and unlock the bolt;

in view C, retraction of the bolt handle 2.3 in the direction of the butt stock 5 and ejection of the case 11.

Thus, the presence of the handle extension 2.2 allows to bring the handle 2.3 closer to the trigger 3.1 at the distance "A" (FIG. 2), which can be zero.

The variant of the handle extension 2.2 (FIG. 6) has the bend 2.5 that allows the ejected case 11 to pass over the handle extension 2.2.

The variant of the handle extension 2.2 (FIG. 7) has the bend 2.6 that allows the ejected case 11 to pass under the handle extension 2.2.

The variant of the handle extension 2.2 (FIG. 8) having in the cross section the form of a ring segment.

In FIG. 9 shows the bolt 2 with the variant of the handle extension 2.2, having the cross section in the form of a ring segment, located in the barrel breech 1.1 and locking the barrel 1.

The variant of the handle extension 2.2 (FIG. 10) having in the cross section the form of a ring segment with the slot 2.7 for the passage of the ejected case 11.

The variant of the bolt 2 (FIG. 11) with the handle extension 2.2, having the reinforcement 2.8.

On FIG. 12 the appearance of the firearm with the bolt 2 having the handle extension 2.2 with the reinforcement 2.8.

The variant, of the bolt 2 (FIG. 13), when the handle extension 2.2 has the protrusion 2.9.

On FIG. 14 variant when the handle extension 2.2 has the protrusion 2.9 entering the recess 3.2 of the receiver 3.

The proposed firearm (FIG. 15) can be made in the variant when the trigger 3.1 is located between the bolt handle 2.3 and the butt stock 5, while the distance "B" can be equal to zero.

On FIG. 16 shows the variant when the bolt handle 2.3 is placed in the recess 6.1 in the pistol grip 6 when locking.

The invention claimed is:

1. A manually operated bolt-action firearm containing a barrel with a breech, a bolt, a bolt handle, a handle extension, the bolt handle being connected to the bolt by means of a handle extension and rotated together with the bolt, wherein the bolt, the bolt handle and the handle extension are integrally formed as a unitary structure, and wherein a distance from the beginning of an attachment of the handle extension to the bolt to the front end of the bolt is no more than 100 mm, a receiver, a trigger, a pistol grip, a butt stock, a magazine located between the butt stock and the pistol grip, characterized in that the bolt handle has an elongated shape in the direction of the trigger so that the bolt handle is located ahead of a forwardmost end of the bolt.

* * * * *